US007412862B2

(12) United States Patent
Anderson et al.

(10) Patent No.: US 7,412,862 B2
(45) Date of Patent: Aug. 19, 2008

(54) SHEET BENDING BRAKE

(75) Inventors: Carl Anderson, Scranton, PA (US); Kevin Jablonski, Scranton, PA (US)

(73) Assignee: Alum-A-Pole Corporation, Scranton, PA (US)

( * ) Notice: Subject to any disclaimer, the term of this patent is extended or adjusted under 35 U.S.C. 154(b) by 108 days.

(21) Appl. No.: 11/326,586

(22) Filed: Jan. 5, 2006

(65) Prior Publication Data

US 2006/0191309 A1 Aug. 31, 2006

Related U.S. Application Data

(60) Provisional application No. 60/641,497, filed on Jan. 5, 2005.

(51) Int. Cl.
*B21D 5/04* (2006.01)
*B21D 43/28* (2006.01)

(52) U.S. Cl. ..... 72/31.1; 72/294; 72/319

(58) Field of Classification Search ..... 72/294, 72/319, 320, 31.1; 269/229, 236
See application file for complete search history.

(56) References Cited

U.S. PATENT DOCUMENTS

| | | | | |
|---|---|---|---|---|
| 537,663 | A | 4/1895 | Wurster | |
| 1,126,611 | A | 1/1915 | Wright | |
| 1,495,404 | A * | 5/1924 | Decker | 269/87.1 |
| 3,380,158 | A | 4/1968 | Du Bois | |
| 3,726,120 | A | 4/1973 | Hugert | |
| 3,771,440 | A | 11/1973 | Eburn, Jr. | |
| 3,796,201 | A | 3/1974 | Golub | |
| 3,946,588 | A * | 3/1976 | Mayston | 72/466.8 |
| 4,033,388 | A | 7/1977 | Ruegger | |
| 4,186,489 | A * | 2/1980 | Vigilante et al. | 33/2 H |
| 4,351,176 | A | 9/1982 | Anderson | |
| 4,364,254 | A | 12/1982 | Chubb et al. | |
| 4,658,624 | A | 4/1987 | Ridgway et al. | |
| 4,671,094 | A * | 6/1987 | Break | 72/319 |
| 4,700,937 | A | 10/1987 | Naylor | |
| 4,918,966 | A | 4/1990 | Raccioppi, Jr. | |
| 4,958,577 | A | 9/1990 | Demaio et al. | |
| 5,036,740 | A | 8/1991 | Tsai | |

(Continued)

FOREIGN PATENT DOCUMENTS

| | | |
|---|---|---|
| FR | 2504429 | 10/1982 |

(Continued)

OTHER PUBLICATIONS

Tapco Pro Cut Off Gauge Instructions, Item #12250, downloaded from http://www.tapcotools.com/pro_cut_off_gauge. php on May 31, 2007.

*Primary Examiner*—Daniel C Crane
(74) *Attorney, Agent, or Firm*—Myers Wolin, LLC

(57) ABSTRACT

A bending brake for sheet material includes frames; an upper jaw and a lower jaw that cooperate to hold the sheet material a bending surface pivotally connected to the lower jaw to bend the sheet material against an anvil of the upper jaw; an interlocking unit connected to the frame and having a cam surface which has having a locking position; and an elongated pipe assembly for rotation by a user. The elongated body bears against the cam surface and rests in the locking position to clamp the sheet material with reduced freedom of play.

26 Claims, 15 Drawing Sheets

U.S. PATENT DOCUMENTS 5,404,739 A 4/1995 George, II
5,538,147 A 7/1996 Fucci
5,582,053 A 12/1996 Chubb et al.
5,706,692 A 1/1998 Chubb et al.
5,761,939 A * 6/1998 Spencer et al. ..... 72/31.1
5,860,312 A 1/1999 Anderson
6,000,268 A * 12/1999 Van Cleave et al. ..... 72/211
6,082,164 A 7/2000 Palmer
6,701,767 B2 3/2004 Hartwell et al.
6,748,783 B1 * 6/2004 Chubb et al. ..... 72/294
6,748,784 B1 * 6/2004 Chubb et al. ..... 72/319
6,854,314 B2 * 2/2005 Cleave et al. ..... 72/319
6,959,580 B2 * 11/2005 Break ..... 72/319
7,021,096 B2 * 4/2006 Barnett ..... 72/31.1
7,043,950 B2 * 5/2006 Clark et al. ..... 72/31.1

FOREIGN PATENT DOCUMENTS

JP 56-77026 A 6/1981

* cited by examiner

SHEET BENDING BRAKE

RELATED APPLICATIONS

The present invention is a non-provisional counterpart to and claims priority from U.S. Ser. No. 60/641,497 filed on Jan. 5, 2005, which is hereby incorporated by reference for all purposes.

BACKGROUND OF THE INVENTION

1. Field of the Invention

The present invention is directed to portable construction equipment, and more particularly, to sheet bending brakes.

2. Background

The use of some machines calls for supporting a workpiece while presenting it with a particular orientation to the machine. For example, a common bending machine, known as a sheet bending brake ("brake"), is operative to bend a substantially flat workpiece of sheet material. Such sheet material typically are made of aluminum, one or more compositions of vinyl, or the like and are used in siding structures, houses, railings or the like.

In order to bend such a workpiece using a typical sheet bending brake, ordinarily, the workpiece is first positioned upon the brake's clamping surface so that the edges of the workpiece have a desired orientation with respect to the brake. Commonly, a rectangular workpiece is positioned so that its front and rear edges are generally parallel to the front side of the brake.

Such a position allows the typical brake to bend the workpiece along a line that is generally parallel to the workpiece's front and rear edges. It is common for the craftsman of a brake to position the workpiece manually, perhaps with the assistance of a helper, controlling the workpiece's orientation as it is presented to the brake. As the craftsman positions the workpiece upon the brake's clamping surface, he visually estimates, or perhaps determines with the assistance of temporary markings placed upon the workpiece, whether the workpiece is properly oriented or aligned relative to the brake.

Considering that each workpiece is typically a several feet long, proper orientation and alignment operations take an inappropriately long time. Often, as the craftsman approaches one end of the workpiece, the opposite end of the latter may be accidentally moved out of alignment. Accordingly, it would be desirable to simplify these operations by providing, for example, stoppers operative to prevent the workpiece portion from accidental displacement.

Typically, the workpiece must be cut from a coil of continuous sheet of material. This presents a problem as the coil is tightly wound for efficient shipping and storage. Once the retaining tape is removed the coil springs to unwind and is easily damaged or becomes soiled. To obviate this problem, craftsmen may work together—one craftsman unwinds the coil to the desired length of the individual workpiece and the other holds the still wound coil segment. However, this is highly inefficient use of manpower. Thus, it has been suggested that the coil be retained in some fashion while still being able to be unrolled.

One suggestion is to use a cradling device that is positioned on its own legs adjacent to the bending brake. The material is then unrolled, cut and fed one at a time into the bending brake for bending. Problems are inherent with such an arrangement; for example while unwinding the coil, the cradling device may be knocked over; the coil may slip off the coil support and fall on the ground. Since the craftsman usually prepares numerous individual workpieces, recurrent resetting of the cradling device or mounting of the fallen coil considerably slows the craftsman and makes the entire process inefficient. Having the bending brake provided with a means for securing the coil can improve the efficiency of this machine.

Furthermore after unwinding the coil at the desired length and using a cutter to sever the individual workpiece from the rest of the coil, the craftsman has a need to place the workpiece somewhere so as to proceed to cut the next workpiece or perform some other task. Typically, the workpieces end being aggregated on the ground where they are damaged or soiled. Thus, it would be desirable to have a table at the worksite so that the workpieces are stacked upon one another on that table. To accommodate this need, conscientious craftsmen attempt to fashion their own table. By necessity such a table must be long enough and wide enough for the cut workpieces. As a rule, such a table has a relatively cumbersome structure. Since equipment must be moved to new job sites, cumbersome tables are not desired. Therefore, it would be desirable to have the table that can be folded and/or easily transported and that would work efficiently to receive workpieces cut from the coil.

Furthermore, at least some of the components of the known bending machines may not be ergonomically designed and tend to make the craftsman's job rather difficult. For example, some of the known brakes have rulers used by the craftsman to mark a portion of the individual workpieces that has to be bent. As mentioned before, each workpiece is typically a few feet long. Accordingly, while the craftsman marks different regions of the single workpiece for further uniform cutting or bending, he/she moves along the workpiece. The rulers, which typically extend transversely to the longitudinal axis of the machine, tend to interfere with the craftsman's movement. It would be desirable to mount the rulers to the machine in a manner allowing the craftsman to swing them to a position, in which the rulers would not hinder the craftsman's work.

After the portion of the workpiece to be bent is uniformly marked, the craftsman clamps the workpiece between holding jaws and pivots them to an operative position, thereby bending the workpiece. Some of the known bending machines do not have a mechanism providing a positive lock between the holding jaws and workpiece. Others may be equipped with such a lock, but the structure of the lock may not be safe for the craftsman, who may have his/her fingers trapped in the lock, which can lead to devastating injuries. As a consequence, it is desirable to improve the known lock structures.

Many of the known bending machines also have a slitter operative to cut the workpiece parallel to its longitudinal axis so as to provide the workpiece with the desirable width. Upon cutting, a cutoff portion simply falls on the ground. The craftsman and his assistants, typically, pick up the fallen piece from the floor and put it back on the table for further bending operations, if the width of the cutoff portion allows for such an operation. Clearly, the efficiency of the process is reduced, since picking the cutoff portion from the floor and putting it on the table take a relatively long time. It would be advantageous to provide the bending machine with a support, which is attached to the machine and configured to catch the cutoff piece before it falls on the floor.

A need, therefore, exists for sheet bending brakes that operate in an efficient manner.

Another need exists for sheet bending brakes that have an ergonomically configured structure.

Another need exists for sheet bending brakes provided with a support that prevents falling cutoff pieces on the ground.

Still a further need exists for sheet bending brakes that have an easily foldable and transportable structure.

I. SUMMARY OF THE INVENTION

The present invention provides a number of improvements in sheet bending brakes directed to increase their efficiency. These improvements may be implemented separately from each other, or more preferably in combination with each other, as in the preferred embodiment of the invention herein disclosed.

A bending brake, configured in accordance with the invention, includes a main frame supporting a table that has two halves pivoting relative to one another between a working position, in which the halves are unfolded, and a folded position, in which one of the halves lies atop the other. The working position allows the craftsman to mount a coil of sheet material, repeatedly unwind the coil at the desirable length and cut individual sheet material strips, which further can be bent. The folded position drastically reduces the dimensions of the inventive bending brake, which can be easily transported or stored in a space-effective manner.

While the bending brake has numerous applications, most frequently, it can be seen at a construction site. Typically, the craftsman and assistants displace the bending brake around the site as close as possible to the desired location so as to continue a construction process in a time-effective manner. To facilitate transportation of the bending brake around the site, the inventive bending brake is provided with two removably mounted legs and a pair of wheels, which are mounted on a bracket between the legs. If the craftsman desires to move the bending brake, the legs may be decoupled from the main frame, which, thus, remains supported only by the wheels and can be moved by a single person alone or by a small group of people on any turf including grass.

After the bending brake has been positioned at the desired location, the craftsman couples a coil holder to the main frame. The coil holder, like many other details of the inventive brake, has a structure that allows the craftsman to work in a time-effective manner. For example, to prevent the coil of sheet material from falling on the ground, the holder has a pair of grippers reliably holding the coil until and unless the craftsman unlocks them. In accordance with a further aspect, the coil holder is provided with a built-in slitter assembly configured to sever an unwound strip of sheet material, which has the desired length.

Having severed the desired number of sheet material strips, which are temporarily stored on the table, the craftsman may sequentially place the stored strips in the bending brake. In accordance with one aspect, the bending brake includes a mainframe assembly and has a plurality of spaced apart and uniformly configured frames. Provided with a plurality of rails and guides, the bending brake allows for placing and clamping of each sheet material strip in a precise cutting position. The built-in slicer is displaceable along the entire length of the mainframe and mounted thereon in a manner preventing its voluntary decoupling from the entire assembly.

Numerous measuring features including pivotal and telescopic arms provided with measuring tapes are ergonomically designed to exclude any interference with the craftsman's work during the entire process. The telescopic arms functioning as a measuring unit for multiple bends of the same strip, are also used as a support table for the cut-off pieces of the clamped strip.

These and other inventive features will be explained in detail in the following detailed description of the invention.

II. BRIEF DESCRIPTION OF THE DRAWINGS

FIG. 1 is a front isometric view of a sheet bending brake in accordance with one embodiment of the present invention.

FIG. 2*a* is a side view of a sheet bending brake in accordance with one embodiment of the present invention.

FIG. 2*b* is a side view of a side view of a sheet bending brake in accordance with one embodiment of the present invention.

FIG. 2*c* is a side view of a side view of a sheet bending brake in accordance with one embodiment of the present invention wherein the sheet material has been bent.

FIG. 2*d* is a detail view of a side view of a sheet bending brake in accordance with one embodiment of the present invention.

III. DETAILED DESCRIPTION

Figure 1:
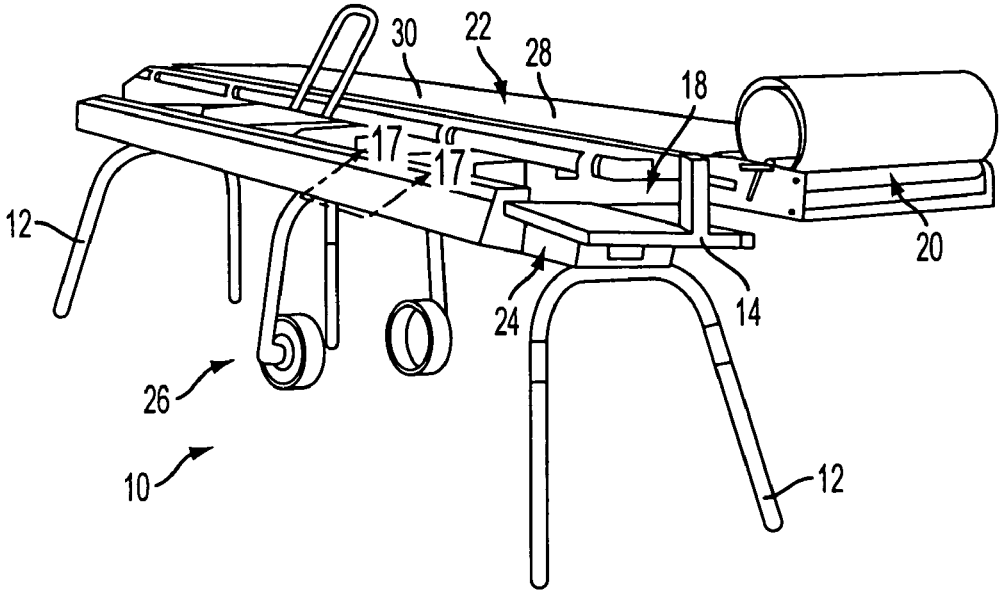

Reference will now be made in detail to the entire assembly of the invention that is illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, left, right, up, down, over, above, below, beneath, rear, and front may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

The inventive bending brake assembly 10, as shown in FIG. 1, is operative to provide a high output production of bent and hemmed strips of sheet material in a time-effective and craftsman-friendly manner. Constructed as a modular structure, bending assembly 10 includes several major components that are easily couplable with one another to form a relatively light and compact structure.

A main frame 14 of assembly 10 includes a combination of rails and guides supporting a bending brake 18, work table unit 22, coil holder unit 20, and bending/cutting unit 24, each of which is discussed below in detail. Mounted on at least a pair of leg units 12, assembly 10 is also provided with a wheel unit 26 for easy transportation.

Figure 2A:
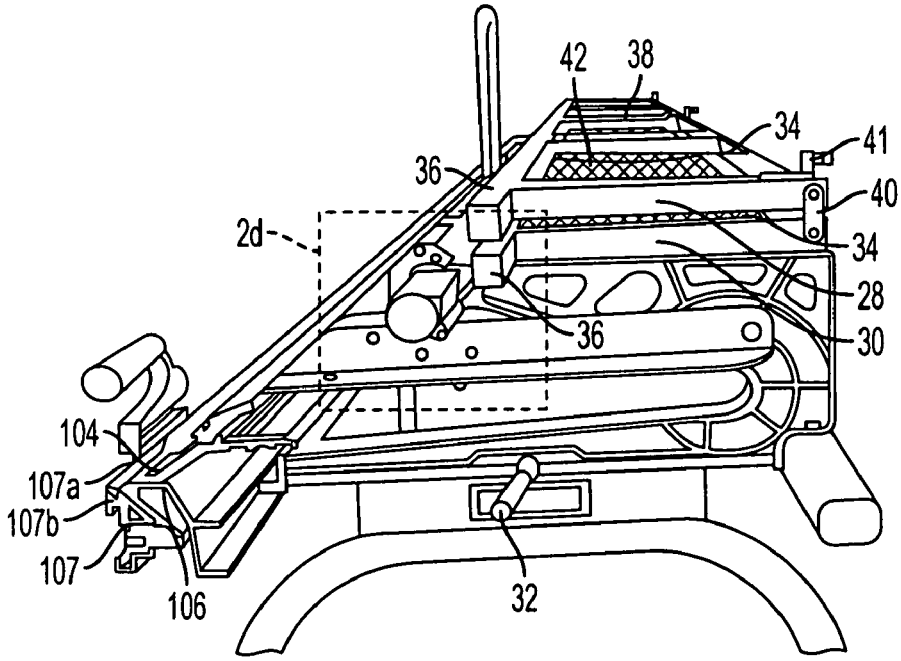

As a compact structure, the inventive bending brake assembly is delivered to a construction site in a folded position and characterized by foldable work table unit 22, in which its rear half 28 is rotated so as to rest atop front half 30 (FIG. 2*a*). Although leg units 12 are shown as attached to mainframe 14, each of them can be dismounted from the frame by simply operating a respective one of leg handles 32 (FIG. 2*a*) that are mounted on opposite sides of mainframe 14. In addition, legs units 12 may be pivotally mounted to frame 14 and, instead of being completely detached from the frame, each leg unit may rotate to a rest position, in which it extends substantially parallel to the bottom of frame 14.

The table halves 28 and 30 each are configured with a respective frame 34 including a pair of longitudinal bars 36 and a plurality of crossbars 38. Preferably, each longitudinal bar 36 has a rectangular cross-section, but this cross-section, of course, may be different. Two hinge assemblies 40 bridge inner sides of opposite ends of the table haves for providing an easy folding/unfolding operation of table unit 26. Top surfaces of each half 28 and 30 are covered by a respective screen 42 preferably made of wire 44. Front and rear top elongated bars 36 each have a respective extension 46 serving for receiving coil holder unit 20, as will be explained below.

Figure 3:
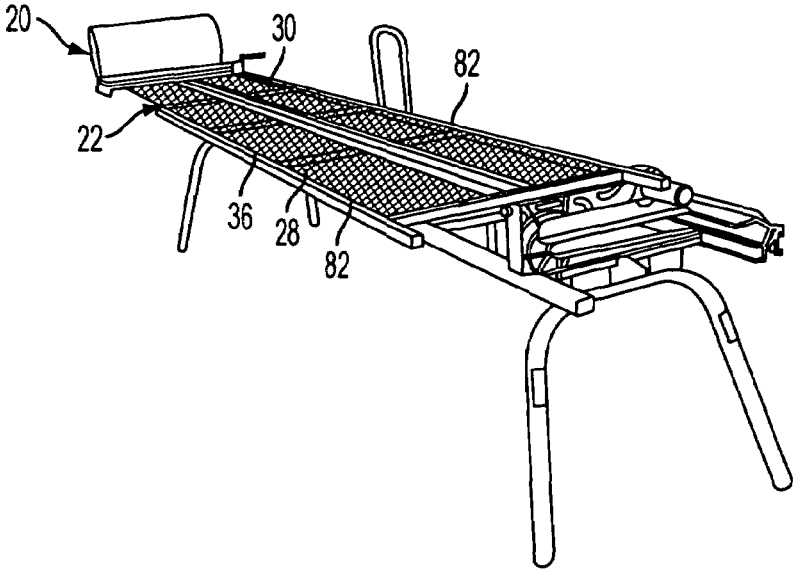
FIG. 3 is a rear isometric view of a sheet bending brake in accordance with one embodiment of the present invention.

Having selected the desirable location for bending brake assembly 10 at the construction site, the craftsman then rotates rear half 28 of the table unit away from front half 30 to the unfolded or working position of table unit 22. To complete the conversion of brake assembly 10 from a storing position to a working one, the craftsman further mounts coil holder 20 to either of the opposite sides of table unit 22, as shown in FIG. 3.

Figure 5:
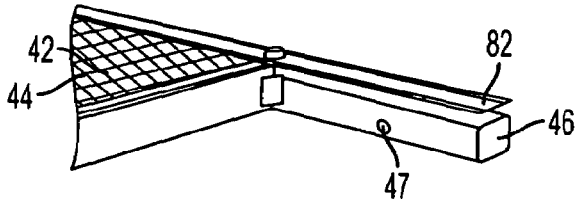
FIG. 5 is a detail view of a portion of the table of a sheet bending brake in accordance with one embodiment of the present invention.

Coil holder 20, whose structure is illustrated in FIG. 5 includes a pair of longitudinal L-shaped sides 50, a plurality of cross members 52, which bridge and couple L-shaped sides 50, a plurality of rollers 54 for providing a smooth delivery of material onto work table unit 22, and a cutting assembly 56.

Figure 6:
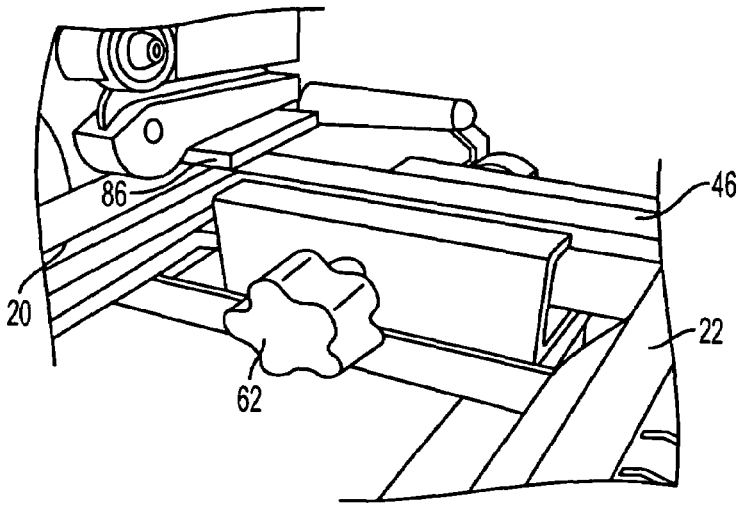
FIG. 6 is a detail view of a portion of a coil holder in accordance with one embodiment of the present invention.

To mount coil holder 20 to table unit 22, the craftsman initially grabs the coil holder by inserting his hands through a pair of recesses 58 each formed approximately midway between the opposite ends of a respective one of L-shaped sides 50. The inner end of each L-shaped side 50 has a mounting C-shaped bracket 60 provided with an attachment unit, which, in turn, includes a handle 62 fixed to a bolt. The craftsman holds the coil holder so that each bracket 60 receives a respective inner side of extension 46 (FIGS. 4, 5, 6) of table unit 22 in such a manner that the bolts each extend into a respective threaded holes, which are formed on extension 46. Upon rotating handles 62, which are ergonomically structured to provide a reliable grip for the craftsman, he/she tightens the bolts and, thus, secures holder 20 to table unit 22, as shown in FIG. 6.

Figure 7:
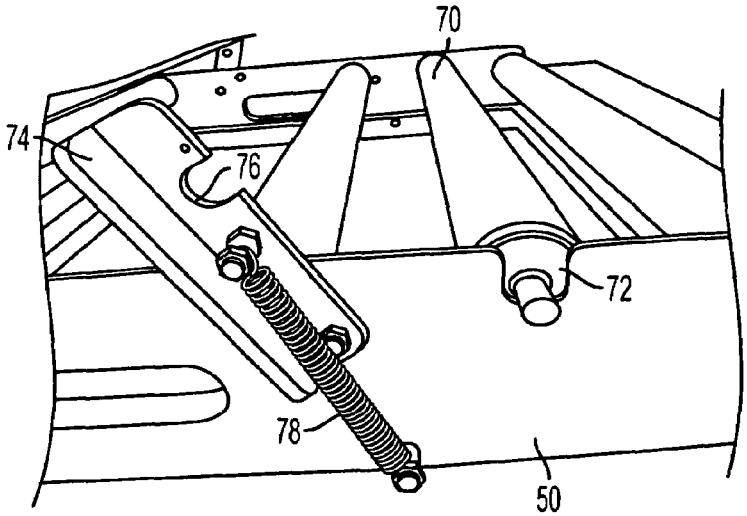
FIG. 7 is detail view of a portion of a coil holder in accordance with one embodiment of the present invention.

Thereafter, the craftsman loads the coil holder 20 with a coil of sheet material 64 (FIG. 8) in the following manner. The craftsman pulls roller 70 off the coil holder, inserts it into coil 64 and further places opposite ends of roller 70 into U-shaped recesses 72. To prevent displacement of roller 70, the craftsman pivots spring-loaded levers 74 towards roller 70 so that recesses 76, each of which is formed on a respective one of levers 74, engage the opposite ends of roller 70 and lock this roller into place. Since levers 74 are biased towards the roller 70 by springs 78, not only roller 70 is reliably secured to L-shaped longitudinal members 50 of coil holder 20, but also coil 64 is biased towards and frictionally engages rollers 71 and 73 (FIG. 7).

Figure 4:
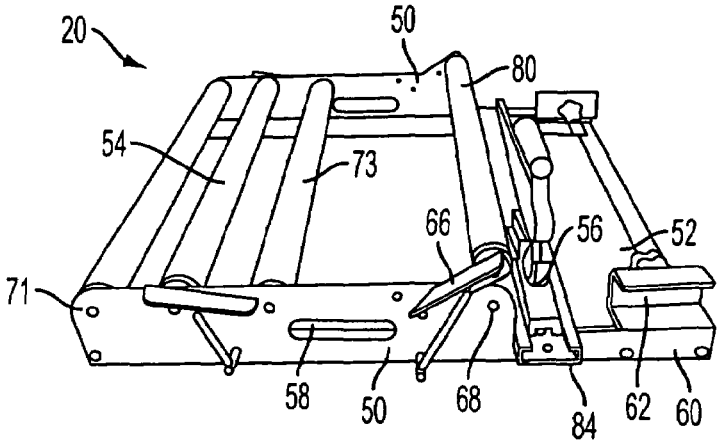
FIG. 4 is an angled view of a coil holder in accordance with one embodiment of the present invention.
Figure 8:
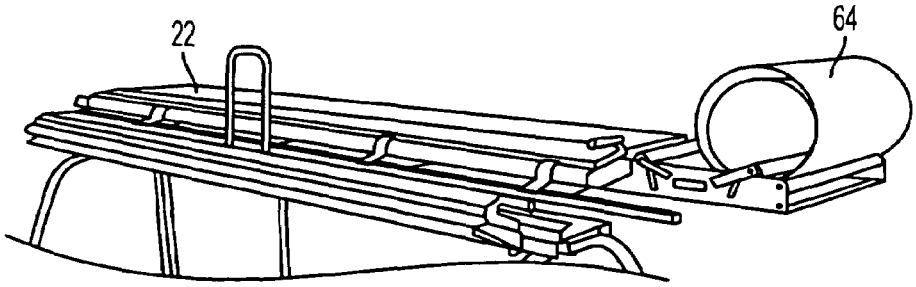
FIG. 8 is an isometric view of a sheet bending brake in an operational condition in accordance with one embodiment of the present invention.

After coil 64 is secured to coil holder 20, the craftsman pulls the leading edge of the coil over an inner roller 68 (FIG. 4). Finally, pivoting inner spring-loaded levers 66 (FIG. 4), which support a roller 80, so that the leading edge of coil 64 is sandwiched between rollers 80 and 68, the loading operation of the coil is completed, as shown in FIG. 8.

Sheet bending brake assembly 10 is now ready for a subsequent operation, during which the craftsman may prepare a plurality of strips of material each having the desired length, as will be discussed immediately below.

Figure 9:
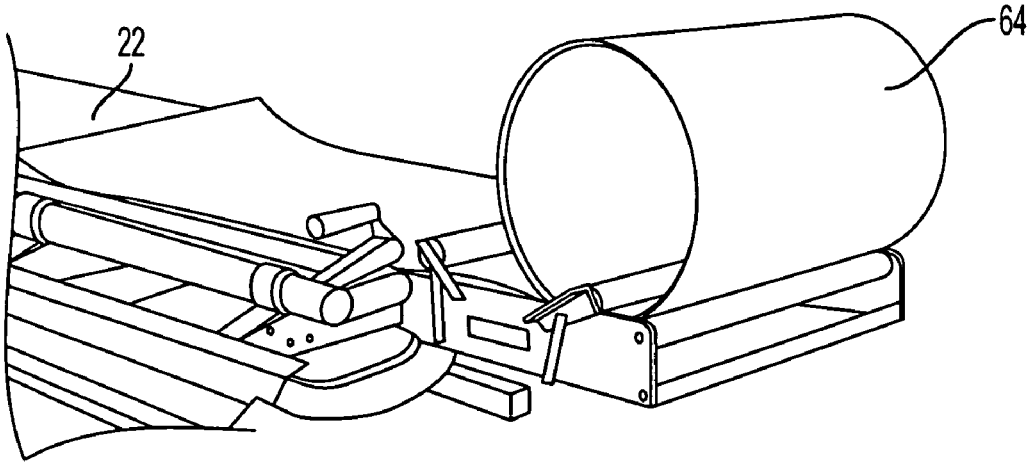
FIG. 9 is a detailed view of a portion of a sheet bending brake in a further operational condition in accordance with one embodiment of the present invention.
Figure 10:
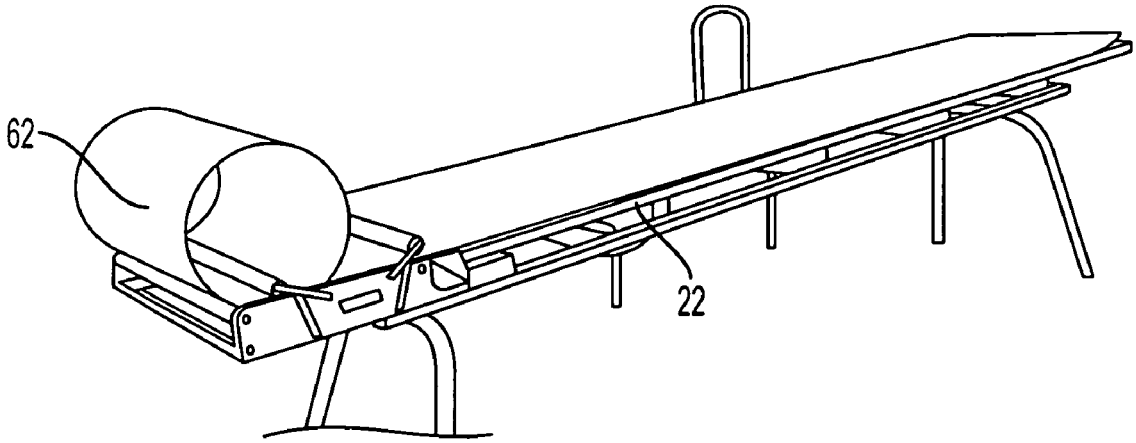
FIG. 10 is an isometric view of a sheet bending brake in a further operational condition in accordance with one embodiment of the present invention.

Preparation of each individual strip of sheet material includes a measuring step, during which the craftsman applies a pulling force to the leading edge of material as shown in FIG. 9 and unwinds the coil 64, so that the individual strip having the desired length lies atop table unit 22, as illustrated in FIG. 10, and a severing step. Since each of rollers 54 (FIG. 4) has a respective plastic core, which is wrapped by a mesh screen, and sheet material is reliably engaged by the rollers, unwinding coil of material 64 requires an insignificant force and can be done in a time-effective and precise manner.

To facilitate the precise measurement of the individual strips of sheet material, front and rear top edges of elongated sides 36 of table unit 22 each have a respective measuring tape 82 (FIGS. 5 and 11) extending along the entire length of the table. The reason why both top edges of sides 36 have measuring tapes 82 is because coil holder 20 can be mounted on either end of table unit 22 and, depending on the direction in which the craftsman pulls an individual strip along the length of assembly 10, he/she always can conveniently determine the desired length.

Figure 11:
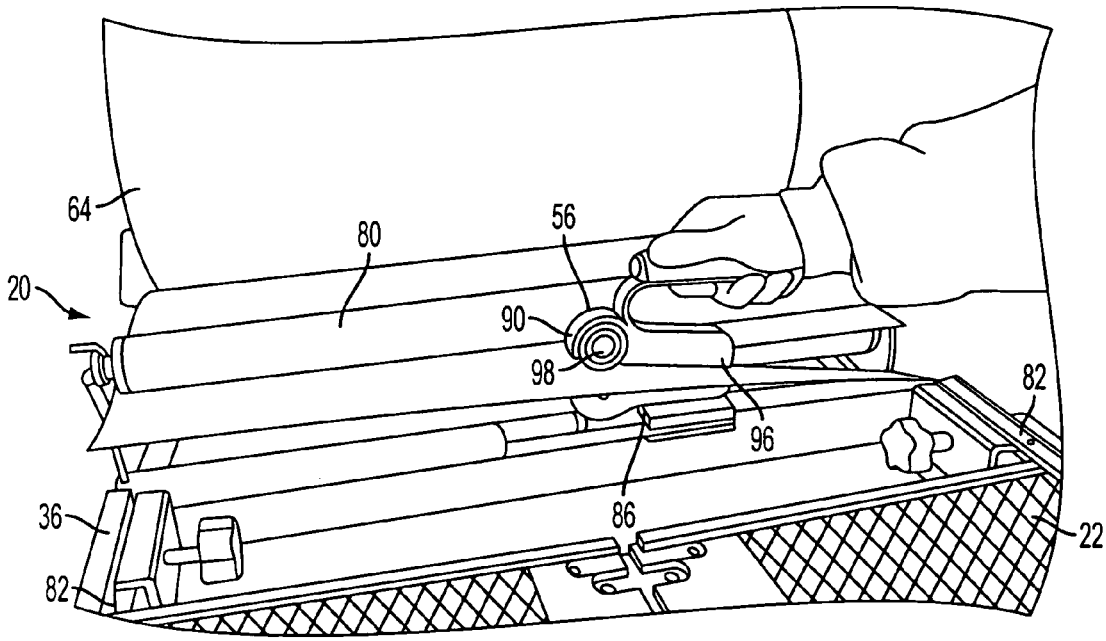
FIG. 11 is a front view of a coil holder in accordance with one embodiment of the present invention.
Figure 12:
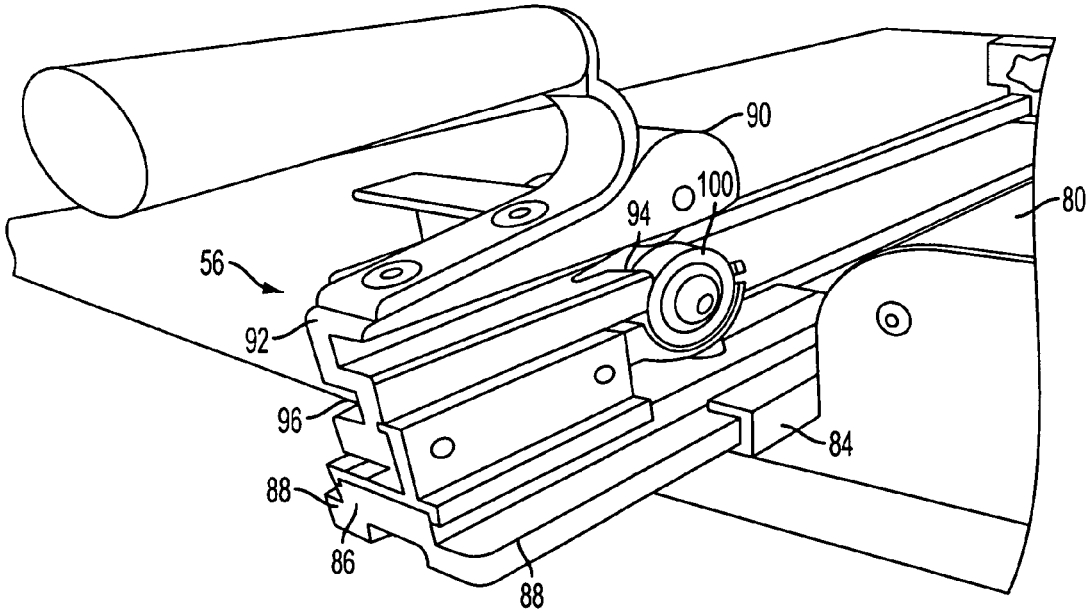
FIG. 12 is a detailed view of a portion of a coil holder in accordance with one embodiment of the present invention.

Having completed the measuring step, the craftsman actuates cutting assembly 56, FIGS. 11 and 12, to sever the individual strip from the coil of sheet material. The cutting assembly 56 is configured with a C-shaped rail 84 (FIG. 12) having an upwardly open guide channel, which is configured to guide a carriage 86 (FIG. 8). The carriage 86 is relatively short by comparison with rail 84 and has two opposite flanges 88 each received within the guide channel of rail 84 so that the carriage can slide along the rail. Mounted to carriage 86 is a slicer 90 (FIGS. 11 and 12) having a handle that can be gripped by the craftsman who applies a force to the handle so as to displace the carriage and slicer along rails 84 in a plane extending perpendicular to the opposite elongated edges of the individual strip of sheet material. Having severed one individual strip, the craftsman may continue to sever as many strips as needed.

As further shown in FIGS. 11 and 12, slicer 90 has an S-shaped housing 92 provided with a substantially horizontal outer channel 94, which faces roller 80 of holder assembly 20 and is configured to confine a new leading edge of coil 64 after severing the previous individual strip. Housing 92 is also provided with a slanted inner channel 96 (FIGS. 6 and 12), which is configured to deflect the inner end of the individual strip downwards as the cutting assembly 56 advances across the strip.

Two rollers 98 and 100 perform a cutting operation, each cutter having opposing edges overlapping one another in a vertical plane for severing the strip from coil 64.

Figure 13:
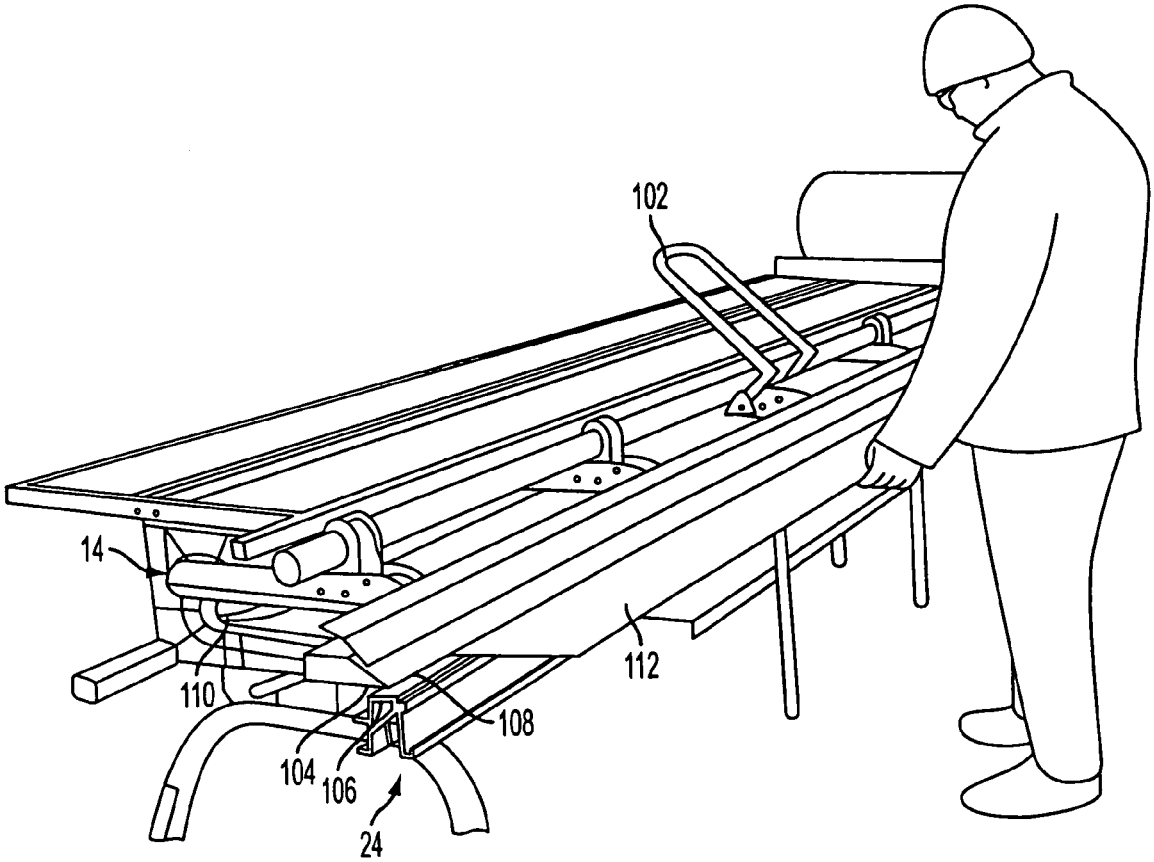
FIG. 13 is a front view of a sheet bending brake receiving a sheet of material in accordance with one embodiment of the present invention.

After severing each individual strip from coil 64 of sheet material, the craftsman can continue with cutting the strip into multiple elongated pieces, since usually the width of individual strips is substantially greater than needed. Referring to FIG. 13, bending/cutting unit 24 constitutes a component of mainframe 14 and is configured to cut individual strips and further bend cut pieces of the strip, as will be explained below.

During the initial stage of the cutting and bending operation, the craftsman pivots a handle 102 (FIG. 13) towards worktable unit 22. Displacement of handle 102, which is removably mounted to a midsection of mainframe 14, causes an upper jaw 104 of the bending assembly to move away from a lower jaw 106 so as to form a passage 108 opening into a C-shaped frame 110. As the strip is guided through passage 108, the craftsman orients it so that only the strip's outer end portion 112 protrudes outwards from jaws 104 and 106, while the rest of the strip lies inside C-shaped frame 110. After aligning outer end portion 112 of the strip, which protrudes from the jaws at the desired distance, the craftsman clamps and subsequently positively locks the strip between the jaws and performs a cutting operation.

Figure 14A:
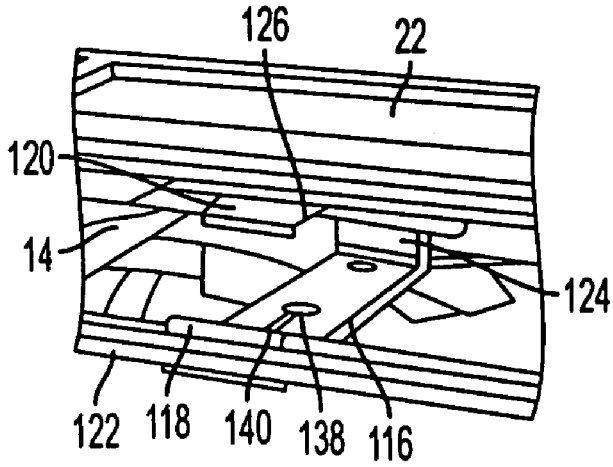
FIGS. 14A and 14B are detailed views of portions of a sheet bending brake in accordance with one embodiment of the present invention.
Figure 14B:
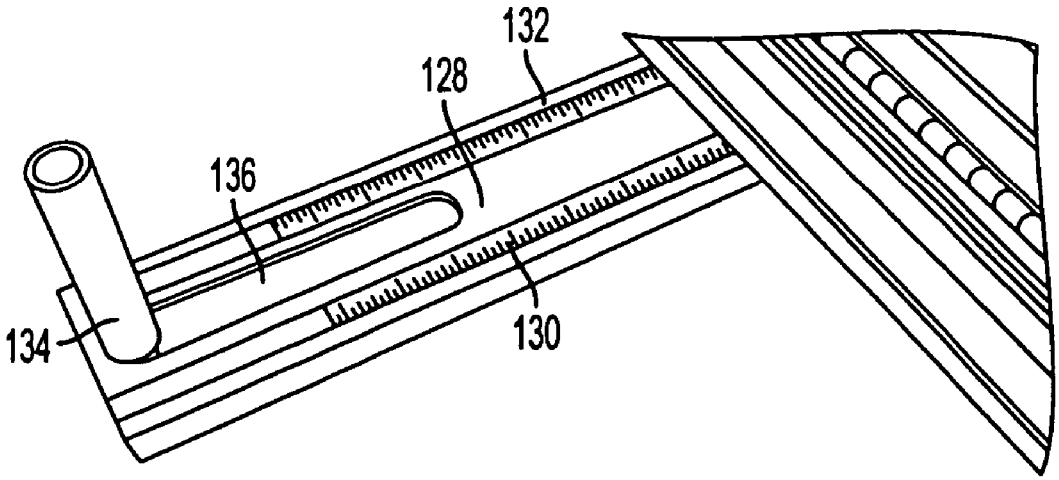

Aligning the individual strip or, in other words, providing strip's outer end portion 112 with the desired width may be realized in accordance with different embodiments. In one embodiment, a measuring/aligning assembly 114, as shown in FIGS. 14A-14B, 15A-15B has at least two units spaced from one another and each including a U-shaped housing 116, which extends under table unit 22 between a rear rail 120 and a front rail 122 of mainframe 14 (FIGS. 13 and 14A). Opposite ends of housing 116 are provided with mounts 118, 124 (FIGS. 14A and 14B), respectively, each of which is configured to receive a respective one of front and rear rails 122 and 120, respectively. Rear mount 124 has a pair of clamps 126 operative to lock the entire unit in the mounting position thereof, in which not a single part or portion of the measuring units extends beyond opposite front and rear rails 122 and 120, respectively, of mainframe 14.

To provide proper measurement or alignment of strips, each unit of assembly 114 has a slideable support arm 128 (FIG. 14B) configured as a U-shaped bracket, which is dimensioned to slide inside U-shaped housing 116. Thus, housing 116 and slideable support arm 128 forms a telescopic arm operative to extend beyond front rail 122 of mainframe 14 at the desired distance.

To set the desired width, the craftsman reaches for slideable support arm 128 and pulls it out. The top of slideable support arm 128 has two rulers, one for bending 132 and one for cutting 130 (FIG. 14B), and is further provided with a handle 134. Having two different rulers is necessary because the bending and cutting assemblies operate in different planes. The handle 134 is pivotally mounted to slideable support arm 128 and swivels between a rest position, in which it extends within a recess 136 so as not to interfere with the slider's displacement, and an erected position, in which handle 134 extends upwards.

After the craftsman adjusts the outer edge of the strip to be cut or bent in accordance with the desired width, he initially pivots handle 102 (FIG. 13) to a clamping position, in which upper and lower jaws 104 and 106, respectively, slightly press upon the opposite sides of the strip. Then, the craftsman displaces slideable support arm 128 so as to have erected handle 134 next to the strip's edge, as shown, for example, in FIG. 15B and locks the strip, thereby preventing its further displacement by tightening assembly 138 (FIGS. 14A and 14B) that extends through elongated parallel slits 140 (FIG. 14B), which are formed in both housing 116 and slideable support arm 128. Assembly 138 includes a bolt extending through slits 140 and having on its top end a head 142 and on the lower end a handle (not shown), which is screwed onto this lower end. The craftsman rotates the handle so as to adjust the pressure of head 142 against the slider's top and, thus, locks displacement of housing 116 and slideable support arm 128 relative to one another in the desired position. This locked position is particularly advantageous for multiple repeat bents.

In accordance with a further embodiment, the measurement operation can be realized by an assembly, which includes a support 144 (FIGS. 15A, 15B and 16), pivotally mounted on and coextending with the upper jaw 104 of bending brake 18, and one or several rulers 146 coupled to support 144. Rulers 146 pivot along with support 144, and each of the rulers may slide along the support and swivel to a respective rest position, in which the rulers extend parallel to support 144. In addition, rulers 146 each are provided with two measuring scales 148 and 150 used for setting the bending and slicing width, respectively.

The measuring assemblies disclosed above can be used separately or in combination with one another. For example, after inserting the individual strip of sheet material in passage 108 (FIG. 13) and displacing handle 102 to the clamping position (FIG. 15B), the craftsman may pivot support 144 with rulers 146 downwards from a position shown in FIG. 15A to a position of FIG. 15B and make necessary measurements on the inserted strip. Thereafter, extending slideable support arm 128 of assembly 114 (FIG. 14B) at the desired distance and displacing handle 134 of slideable support arm 128 to its erected position, the craftsman may make numerous slices and/or bents without further using rulers 146. Assembly 114 is particularly advantageous for ultra accurate repeat bents; excellent for wrapping posts, 4×4's etc. Once, the craftsman does not need to use rulers 146 anymore, he/she pivots the support 144 upwards away from upper jaw 104 (FIG. 16) and, then, swivels rulers 146 to the rest position, in which they do not interfere with the craftsman's work.

After the desired width of a piece to be cut is established, the craftsman moves handle 102 to its locked position, in which the strip is prevented from displacement relative to upper and lower jaws 104 and 106, and begins a slicing operation . A cutting unit 152 including a slicer 154, which can be configured identically to slicer 90 shown in FIGS. 11 and 12.

Figure 15A:
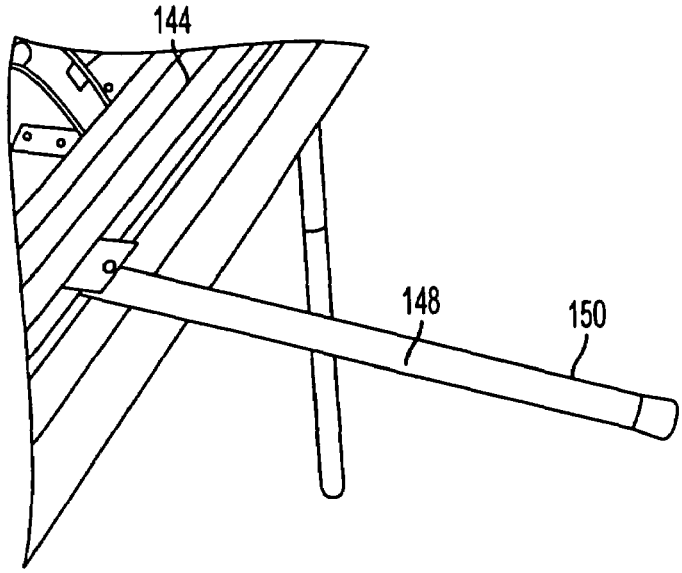
FIGS. 15A and 15B are detailed views of portions of the sheet bending brake in accordance with one embodiment of the present invention.
Figure 15B:
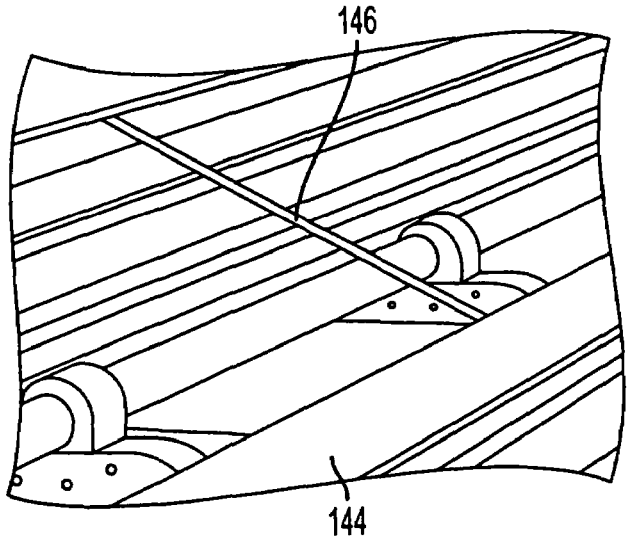
Figure 16:
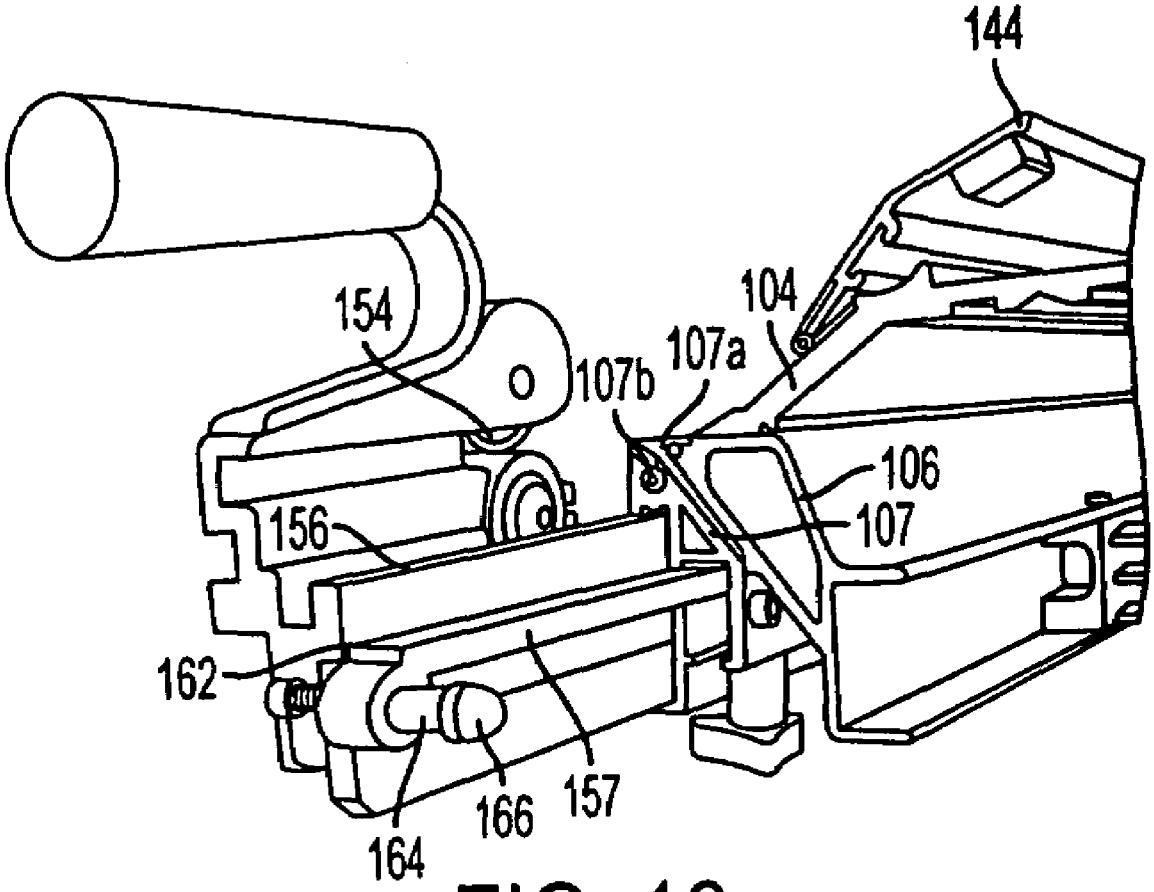
FIG. 16 is a detailed view of a portion of the sheet bending brake in accordance with one embodiment of the present invention.

A mounting assembly of slicer 154, better illustrated in FIGS. 15A and 15B, includes a rail 156 slidably inserted into a C-shaped channel 158 of lower jaw 106, so as to slide along channel 158 along the entire length of the locked strip. Since the length of jaws 104 and 106 is greater than the length of the strip of sheet material, the craftsman is able to position the slider outside the ends of the strip, so it would not interfere with the craftsman's work during measuring and bending operations.

The slicer is so mounted that it cannot accidentally slide off the rail 107 associated with the lower jaw 106, since the mounting assembly of the slicer is provided with a stop unit. The stop unit includes an elongated metal body 158, which has an inner end slidably inserted into a channel 160 of the rail 107 associated with the lower jaw 106, and an outer end provided with a holder 162 that supports a spring-loaded body 164 having a handle 166. In a blocking position, spring-loaded body 164 extends towards lower jaw 106 and arrests displacement of slicer 154, thereby preventing the latter from falling off the jaw. If the craftsman needs to dismount the slicer, he/she will pull handle 166 away from the slicer and simply slides the latter until it goes off rail 107. Since the slicer is mounted to rail 107, it rotates with this rail during a bending operation. Note that body 158 is configured to slide within channel 160 of rail 107 and can be retracted into this channel in the storing position of the assembly 10 so as to minimize the overall the size of the latter.

After one or a numerous number cutoff pieces are produced and stored on table unit 22, the craftsman can begin the bending operation. Similarly to the cutting operation, each piece is inserted into C-shaped frame 110, measured to have the desired width and finally locked upon bringing handle 102 in a locking, upright position.

Figure 2B:
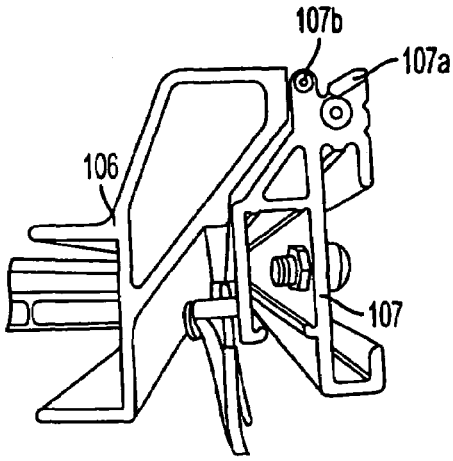
Figure 2C:
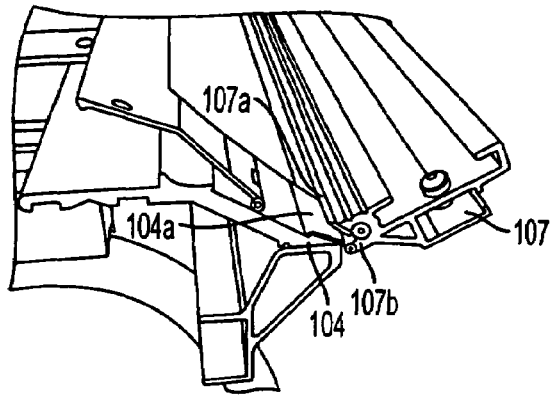

Turning to FIGS. 17-20, showing a section 17-17 of FIG. 1 of the bending brake according to one embodiment of the present invention, the bending assembly includes a bending brake 18 each including an upper arm 170 and a lower arm 172, which supports rail 107 pivotably through a rotation hinge 107*b* which contacts a striking surface 107*a* to an anvil 104*a* on upper jaw 104 to the sheet material (FIGS. 2*b* and 2*c*).

Figure 2D:
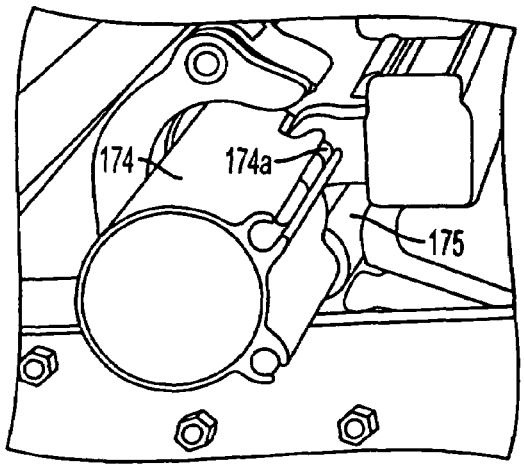

Formed as a one-unit piece, each pair of upper and lower arms 170 and 172 , respectively, defines C-shaped frame 110 that has its rear end attached to rear rail 120, whereas upper arms 170 of bending brake 18 are interconnected with one another by a top circular pipe 174 along a pivot 174*a*. Pipe 174 is associated with a roller 175 that rolls on a cam surface 206 having a rest position 206*a* (FIGS. 2*a* and 2*d*). Pivotally attached to each upper arm 170 is a lever 176, which has two spaced apart and interconnected parts 171 that are fixed to upper jaw 104 and move between an open position of jaws 104 and 106, a clamping position of jaws and a locked position of jaws. Displacement of the upper arm is caused by a force applied by the craftsman to one or more U-shaped handles 102, which are detachably coupled to top pipe 174, during measuring, cutting and bending operations.

Figure 17:
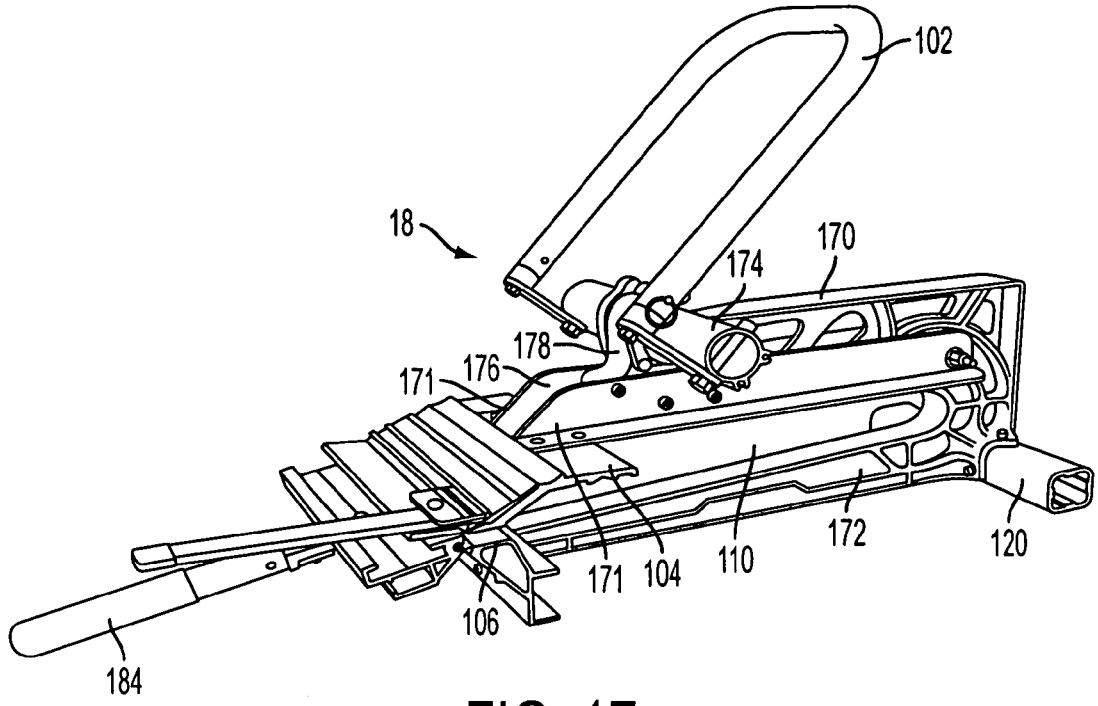
FIG. 17 is a sectional view of a sheet bending brake in operation in accordance with one embodiment of the present invention.
Figure 18:
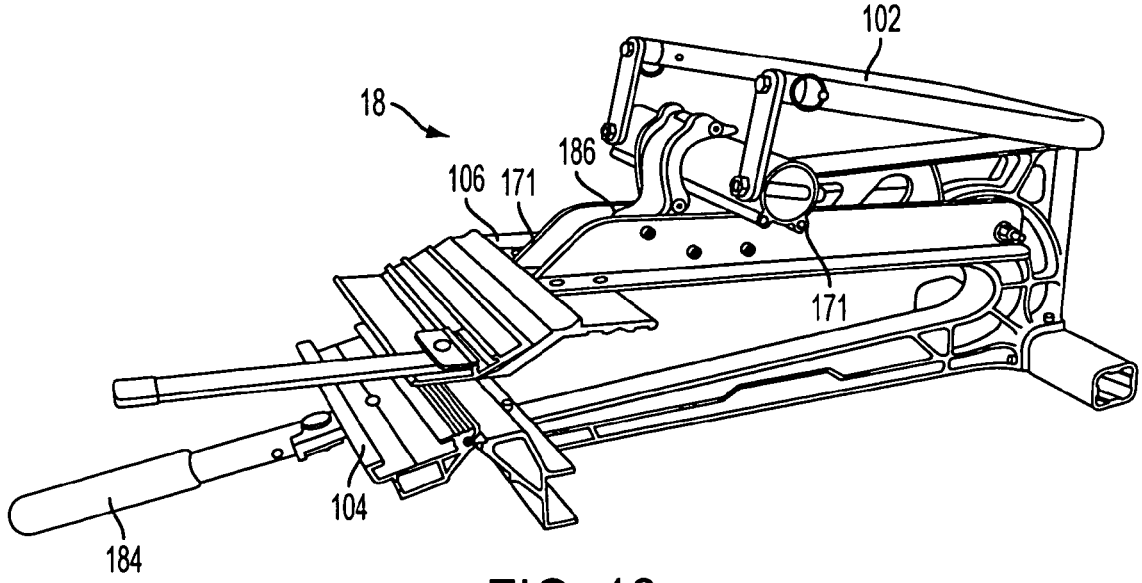
FIG. 18 is a sectional view of a sheet bending brake in further operation in accordance with one embodiment of the present invention.
Figure 24:
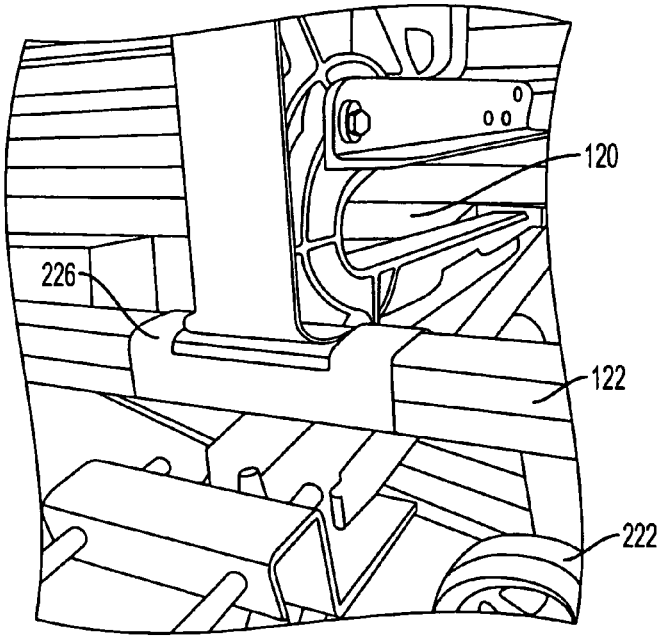
FIG. 24 is a detailed view of a portion of the sheet bending brake in accordance with one embodiment of the present invention.

To lock jaws 104 and 106, the craftsman again applies a pulling force to handle 102, which is translated into pivoting of lever 176 through rotation of top pipe 174 and a lock unit 178, which, in turn, has a flange 186 (FIG. 18) attached to lever 176 between its parts 171. As can be seen in FIG. 24, although inner surface 182 of lock unit's body 204 is curved, it does not extend complementary to top pipe 174 and, thus, serves as a cam that is operative to positively lock the lever 176, when handle 102 extends perpendicular to the clamped strip or piece of material during the slicing and bending operations, respectively. While the craftsman pivots handle 202 along with pipe 174 from the open position of jaws 104 and 106, the pipe 174 pivots and presses roller 175 against and pushes inner surface 182 of the lock unit downwards, which causes lever 176 and upper jaw 104 to follow the lock unit's displacement. At the end of this displacement, the upper jaw approaches and slightly presses against lower jaw 106, thereby bringing the jaws in the clamping position (FIG. 17).

However, in the clamping position, the strip of sheet material engaged between the jaws still can move. To positively lock the clamped strip, the craftsman applies an additional force and brings pipe 174 in positive engagement with the lower portion of inner surface 182, namely cam surface 206, of the lock unit, which corresponds to the locking position of the jaws, namely locking position 206*a*.

During displacement of lock unit 178 relative to pipe 174, the opposing surfaces of these components approach each other and may come in contact, which can either prevent further displacement of the components or, if the craftsman will apply an excessive force, damage them. To avoid such a possibility, body 204 of lock unit 178 is provided with a roller 192 (FIG. 19) guided against pipe 174 only when the jaws move between the open and clamping positions associated with minimal stresses upon the displaceable components. In the locking position, which is associated with very significant forces, roller 192, due to the geometry of inner surface 182 of body 204, is spaced at a distance from pipe 174, thereby effectively operating for a long period of time.

Figure 19:
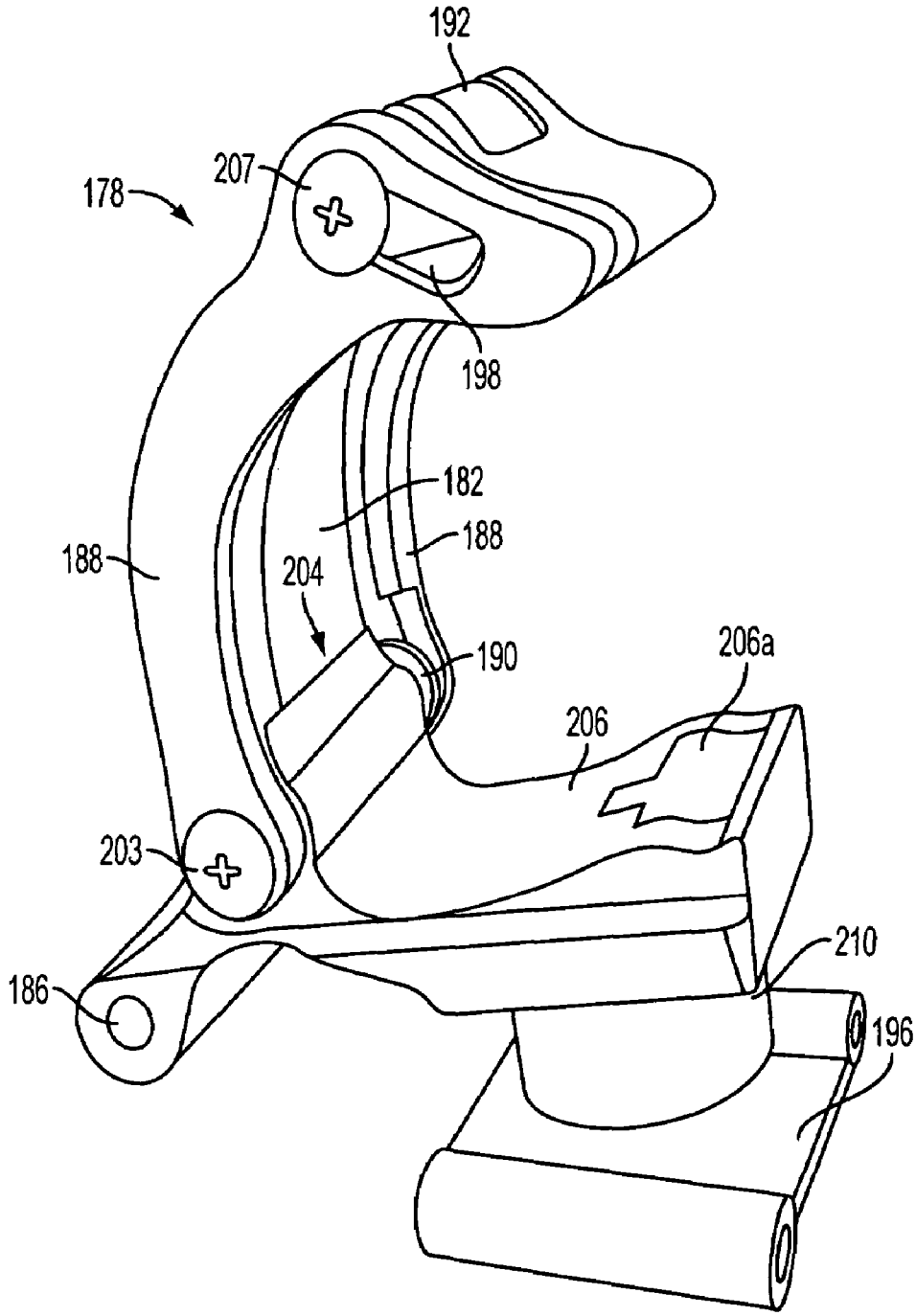
FIG. 19 is an isometric view of a lock unit in accordance with one embodiment of the present invention.

Furthermore, the interlocking unit 178 includes body 204 having inner portion 206. Inner portion 206 includes a cam surface that as shown in FIG. 19 includes a depressed portion, a rising hill portion, and a depressed locking position 206*a*.

Also, in the locking position of the jaws, inner portion 206 of lock unit's body 204 is compressed between pipe 174 and lever 176. It is not unusual that the craftsman may apply an unnecessary excessive force to handle 102 in the locking position of the jaws just to make sure that this position has been indeed established. To ensure that lock unit 178 is not damaged as a result of the additional forces and provide reliable engagement between a base 196 and inner portion 206 of the lock unit, a washer 210 is inserted between the opposing surfaces of these components and coupled to them by a bolt 212 extending through openings 214 (FIG. 20) of these parts, which are aligned upon mounting the lock unit to lever 176.

Eventually, due a heavy use of assembly 10, washer 210 may deform. As a consequence, attachment between lock unit 186 and lever 176 may become less reliable, which, in turn, can lead to the inefficient operation of assembly 10. To compensate deformations of washer 210, bolt 212 has an additional washer 216, which is substantially thinner than washer 210.

Accordingly, if the craftsman feels that the engagement between the jaws is not positive, he may unscrew bolt 212, and place washer 216 next to washer 210, reestablishing, thus, the desired form and size of the latter. This operation is very simple and does not require disassembling of entire lock unit 178.

Figure 20:
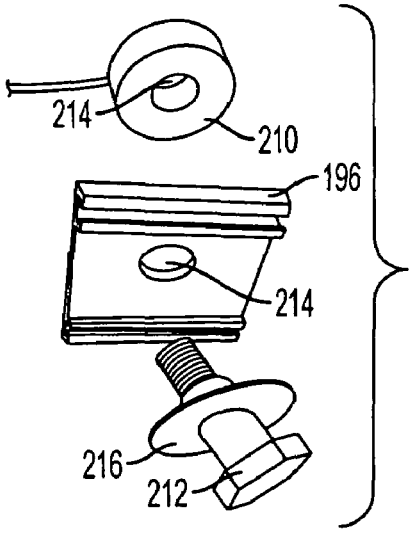
FIG. 20 is a detail view of a portion of a lock unit in accordance with one embodiment of the present invention.

As also shown in FIGS. 19 and 20, lock unit 178 has a frame including two spaced apart, curved guards 188, which are configured so as to prevent any injury to the craftsman during locking and unlocking of upper and lower jaws 104 and 106, respectively. Guards 188 are mounted on and pivot about lower pin 203, which extends through a passage formed in the lower portion of body 204, whereas the upper stretches of these guards are mounted on a second pin 207, which moves along recesses 198 during displacement of the lock unit. When the craftsman rotates handle 102, the inner surface of guards 188 are always in a close proximity of pipe 176 because of their shape and because the guards are biased towards the pipe by a resilient element 190, which is mounted on the opposite ends of pin 203. As a consequence, the fingers of the craftsman cannot be squeezed between the lock unit and the pipe.

Figure 21:
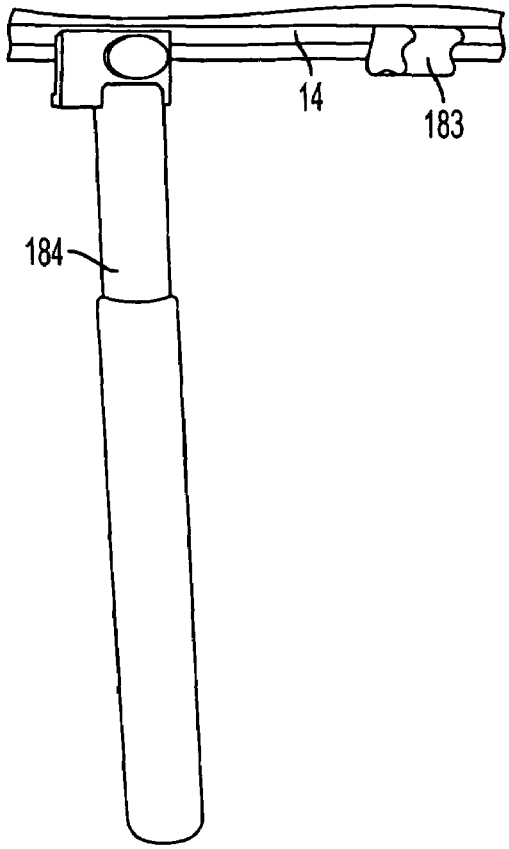
FIG. 21 is a detailed view of a portion of the sheet bending brake in accordance with one embodiment of the present invention.
Figure 22:
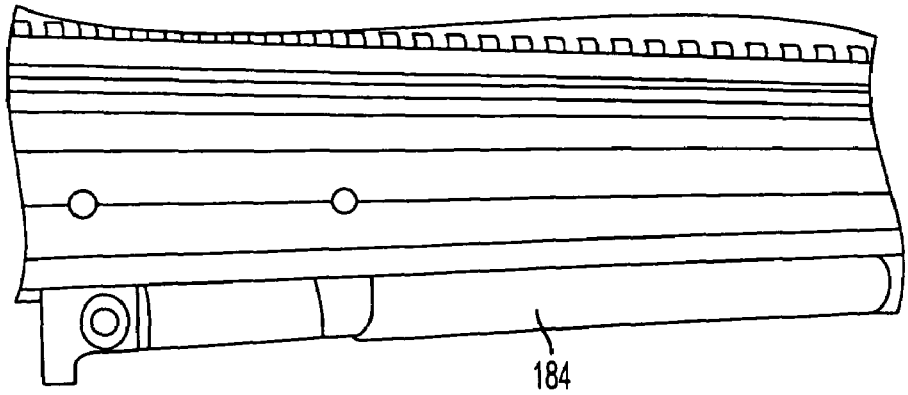
FIG. 22 is a detailed view of a portion of the sheet bending brake in accordance with one embodiment of the present invention.

Upon bringing jaws 104 and 106 in the locking position, the craftsman reaches for one or more handles 184 (FIGS. 18, 21 and 22) and pulls them upwards so as to produce a bend. In a rest position, when the craftsman does not need these handles, they may swivel from a downright position (FIG. 21) to a horizontal position (FIG. 22), in which a U-shaped holder 183 (FIG. 21), mounted to mainframe 14, engages the handle.

Figure 23:
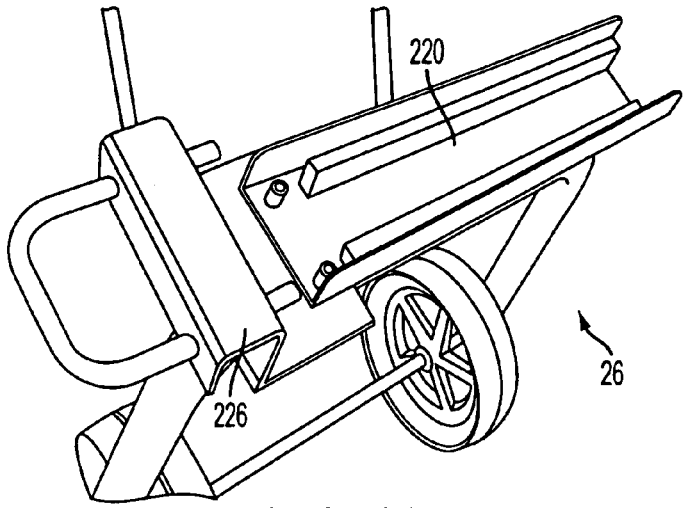
FIG. 23 is a detailed view of a portion of the sheet bending brake in accordance with one embodiment of the present invention.
Figure 25:
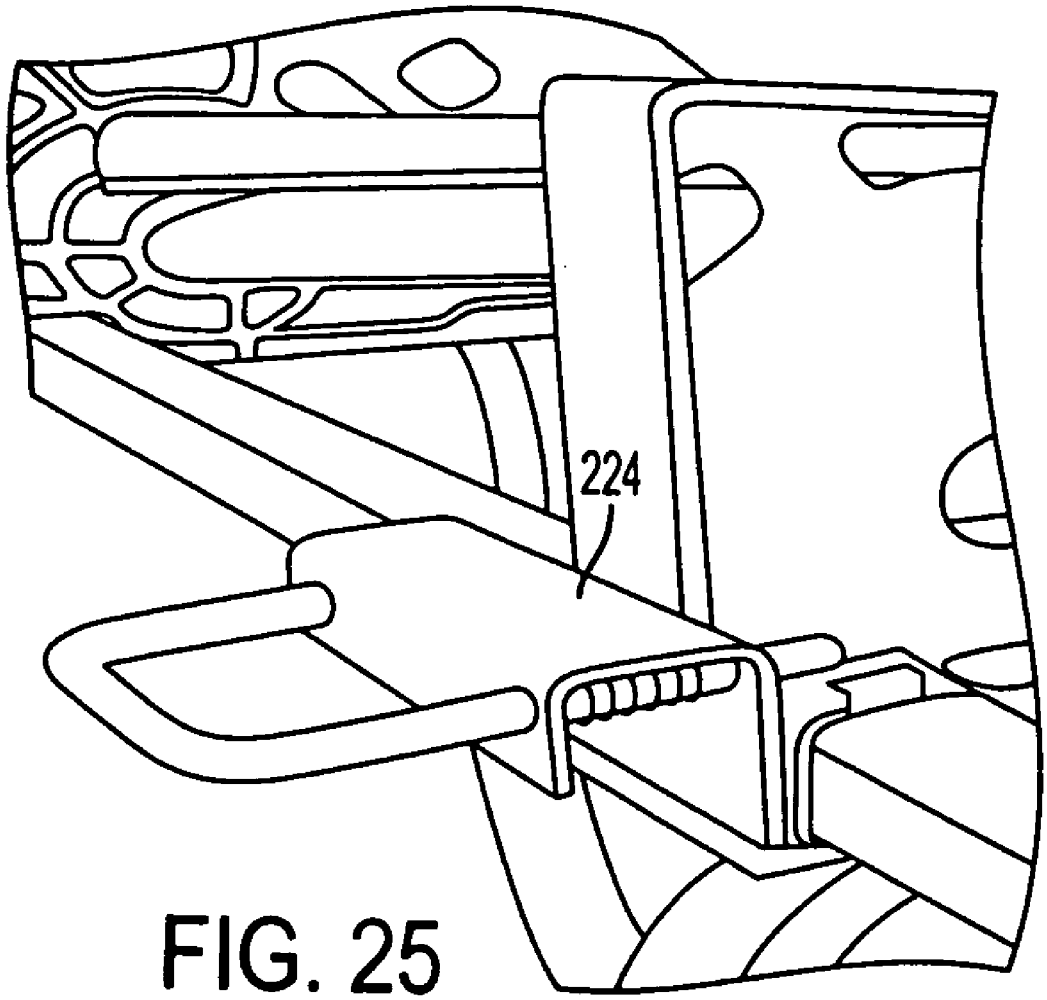
FIG. 25 is a detailed view of a portion of the sheet bending brake in accordance with one embodiment of the present invention.

As is often happens at the construction site, the craftsman may need to move assembly between different locations. To provide easy transportation of the assembly, mainframe 14 can removably support wheel unit 26, as illustrated in FIGS. 23-25. Wheel unit 26 is configured with a frame 220, wheels 222 and handle 224. Frame 220 is shaped and dimensioned to extend under mainframe 14 and has its opposite ends removably attached to front and rear rails 122 and 120, respectively, of the frame. Handle 224 is spring-loaded so that it is biases towards and engages front rail 122. Accordingly, when the craftsman applies a pulling force to the handle, it can be disengaged from the front rail. As can be seen in FIG. 1, in the mounted position, wheel unit 26 does not reach for the ground, since leg units 12 are longer than wheel assembly 26. However, dismounting either one of the leg units or both, allows the craftsman to utilize wheels 222 that are configured similar to wheels of a lawnmower. Frame 220 is so attached to front and rear rails 122 and 120, respectively, that it can slide therealong so as to allow the craftsman to selectively position wheel unit 26 under mainframe 14.

This document describes the inventive assembly for illustration purposes only. Neither the specific embodiments of the invention as a whole, nor images, nor those of its features limit the general principles underlying the invention. The specific features described herein may be used in some embodiments, but not in others, without departure from the spirit and scope of the invention as set forth. Many additional modifications are intended in the foregoing disclosure, and it will be appreciated by those of ordinary skill in the art that in some instances some features of the invention will be employed in the absence of a corresponding use of other features. The illustrative examples therefore do not define the metes and bounds of the invention and the legal protection afforded the invention.

What is claimed is:

1. A bending brake for sheet material, the bending brake comprising:

a plurality of frames;

an upper jaw and a lower jaw cooperating to hold the sheet material, each jaw mounted to each frame of the plurality of frames;

a bending surface pivotally connected to the lower jaw to bend the sheet material against an anvil of the upper jaw;

an interlocking unit connected to the frame, the interlocking unit comprising a cam surface having a locking position in the form of a surface irregularity; and an elongated pipe assembly for rotation by a user, the elongated pipe assembly bearing against the cam surface and resting in the surface irregularity of the locking position to positively lock the elongated pipe assembly and to clamp the sheet material with reduced freedom of play.

2. The bending brake of claim 1, wherein the interlocking unit comprises a guard pivotally biased to prevent accidental user contact with the pipe assembly.

3. The bending brake of claim 1 further comprising a coil holder for holding coiled sheet material for unrolling on the bending brake.

4. The bending brake of claim 3, where the coil holder is detachable for easy removal during transport of the bending brake.

5. The bending brake of claim 3, wherein the coil holder further comprises a cutter for severing a portion of the coiled sheet material.

6. The bending brake of claim 5, wherein the cutter cuts in a direction substantially perpendicular to an axis of one of the jaws.

7. The bending brake of claim 1 further comprising a table for laying out the sheet material.

8. The bending brake of claim 7, wherein the table is foldable for convenient transport.

9. The bending brake of claim 7 further comprising a measuring guide associated with the table.

10. The bending brake of claim 3, farther comprising a table adapted for unrolling coiled sheet directly from the coil holder.

11. The bending brake of claim 1 further comprising a removable stationary leg assembly.

12. The bending brake of claim 11, wherein the stationary leg is lockable against one of the plurality of frames.

13. The bending brake of claim 1 further comprising a removable rolling leg assembly for moving the bending brake from a first position to a second position.

14. The bending brake of claim 1 further comprising a plurality of legs for moving the bending brake and maintaining a stationary position.

15. The bending brake of claim 1 farther comprising a first measuring guide associated with the frame for measuring a distance from a predetermined location, the first measuring guide further comprising a handle that is movable from a first position in alignment with a plane of the first measuring guide, to a second position extended upwardly from the first position.

16. The bending brake of claim 15, wherein the first measuring guide further comprises a recess for receiving the handle in the first position.

17. The bending brake of claim 15, wherein the first measuring guide comprises a stop for permitting repeated use of a measured distance without re-measuring the location.

18. The bending brake of claim 15, wherein the first measuring guide is configured to determine one of a transverse distance of the sheet material from a bending location and a transverse distance of the sheet material from a cutting location.

19. The bending brake of claim 1 further comprising a second measuring guide associated with the upper jaw for measuring a distance from a predetermined location.

20. The bending brake of claim 19, wherein the second measuring guide is pivotable relative to the upper jaw.

21. The bending brake of claim 19, wherein the second measuring guide is mounted in a rail pivotable relative to the upper jaw.

22. The bending brake of claim 21, wherein the second measuring guide is slideable in the rail.

23. The bending brake of claim 19, wherein the second measuring guide is configured to determine one of a transverse distance of the sheet material from a bending location and a transverse distance of the sheet material from a cutting location.

24. A bending brake for sheet material, the bending brake comprising:

a plurality of frames;

an upper jaw and a lower jaw cooperating to hold the sheet material, each jaw mounted to each frame of the plurality of frames;

a bending surface pivotally connected to the lower jaw to bend the sheet material against an anvil of the upper jaw;

an interlocking unit connected to the frame, the interlocking unit comprising a cam surface having a locking position; and an elongated pipe assembly for rotation by a user, the elongated pipe assembly bearing against the cam surface and resting in the locking position to clamp the sheet material with reduced freedom of play;

wherein the elongated pipe assembly comprises a roller for rolling contact with the cam surface.

25. A bending brake for sheet material, the bending brake comprising:

a plurality of frames;

an upper jaw and a lower jaw cooperating to hold the sheet material, each jaw mounted to each frame of the plurality of frames;

a bending surface pivotally connected to the lower jaw to bend the sheet material against an anvil of the upper jaw;

an interlocking unit connected to the frame, the interlocking unit comprising a cam surface having a locking position; and an elongated pipe assembly for rotation by a user, the elongated pipe assembly bearing against the cam surface an resting in the locking position to clamp the sheet material with reduced freedom of play;

wherein the interlocking unit comprises a deformable washer for biasing the pipe assembly against a rising portion of the cam surface.

26. The bending brake of claim 25 wherein the interlocking unit comprises a mounting assembly for adding a second washer for maintaining a biasing force against the rising portion of the cam surface.

* * * * *